US007424962B2

(12) United States Patent
Mooney

(10) Patent No.: US 7,424,962 B2
(45) Date of Patent: Sep. 16, 2008

(54) BALL RETAINER AS A POCKET

(76) Inventor: Kiersten K. Mooney, 8477 Bay Colony Dr., #1002, Naples, FL (US) 34108

( * ) Notice: Subject to any disclaimer, the term of this patent is extended or adjusted under 35 U.S.C. 154(b) by 665 days.

(21) Appl. No.: 10/979,845

(22) Filed: Nov. 2, 2004

(65) Prior Publication Data

US 2006/0091174 A1 May 4, 2006

(51) Int. Cl.
*A45F 3/00* (2006.01)
*A45C 1/04* (2006.01)

(52) U.S. Cl. ..... 224/675; 224/918; 224/919; 2/220

(58) Field of Classification Search ..... 224/919, 224/674, 918, 660, 663, 665, 671, 672, 673, 224/675, 677, 194, 904, 421, 420, 426, 463, 224/572; 2/220, 221, 247
See application file for complete search history.

(56) References Cited

U.S. PATENT DOCUMENTS 2,717,390 A * 9/1955 Houze ..... 2/74
4,800,594 A * 1/1989 Young ..... 2/237
5,186,374 A * 2/1993 Buxton ..... 224/191
5,259,541 A * 11/1993 Reese ..... 224/663
5,341,928 A * 8/1994 Jones et al. ..... 206/315.5
5,586,706 A * 12/1996 Ritzenhein ..... 224/671
5,641,103 A * 6/1997 Potik et al. ..... 224/251
5,772,090 A * 6/1998 Rodriguez ..... 224/251
6,003,747 A * 12/1999 Lee ..... 224/250
6,357,640 B1 * 3/2002 Rickard et al. ..... 224/236
6,769,587 B1 * 8/2004 Lomas ..... 224/663

* cited by examiner

*Primary Examiner*—Nathan J Newhouse
*Assistant Examiner*—Corey N Skurdal

(57) ABSTRACT

A pocket is formed to be carried at a waist of a player playing either golf or tennis. The pocket has a backing and a front made of a fabric that is flexible and stretchable to thereby hold at least three balls under tension while located in the pocket. The pocket is held in a horizontal direction on the waistline of a wearer. The pocket may be attached to a belt surrounding the wearer or instead of a belt may be held in place by way of straps that are mounted on a back side of the pocket and may be passed through slits at the waistline of a pair of pants and held under tension by way of double D-rings.

4 Claims, 5 Drawing Sheets

BALL RETAINER AS A POCKET

CROSS REFERENCE TO RELATED APPLICATION (none)

STATEMENT REGARDING FED SPONSORED R & D (none)

BACKGROUND OF THE INVENTION

The invention pertains to a ball retainer that is carried on the body of a player, more particularly on the body of a golfer, especially by a women. Golfers have a habit of carrying extra balls on their body by having a number of the balls stored in the pockets of their trousers or their shorts as the case may be. In the case of women, the stuffing of balls into their pockets tends to be unsightly, bulky and against fashion trends. The balls are normally carried in the golf bags but the golf bags are not always nearby the player. Therefore, it would be desirable to carry extra balls on a person in a different manner. Golfers also carry other items on their person and that is golf tees and location markers. The inventive concept solves the above noted problems.

BRIEF SUMMARY OF THE INVENTION

It is proposed that extra golf balls be carried on the waist of a golfer in a special ball carrier in the form of a pocket that is carried or attached to the waist of the player including provisions to carry the other items such as golf tees or location markers. The location and the mounting of the pocket as undertaking in an inconspicuous manner. The mounting takes advantage of a belt worn around the waist of the player or in an absence of a belt the pocket can be attached to the waistband of the trousers or shorts the player is wearing. It is noted that tennis balls may equally well be stored in the pocket.

DETAILED DESCRIPTION OF THE INVENTION

Figure 1:
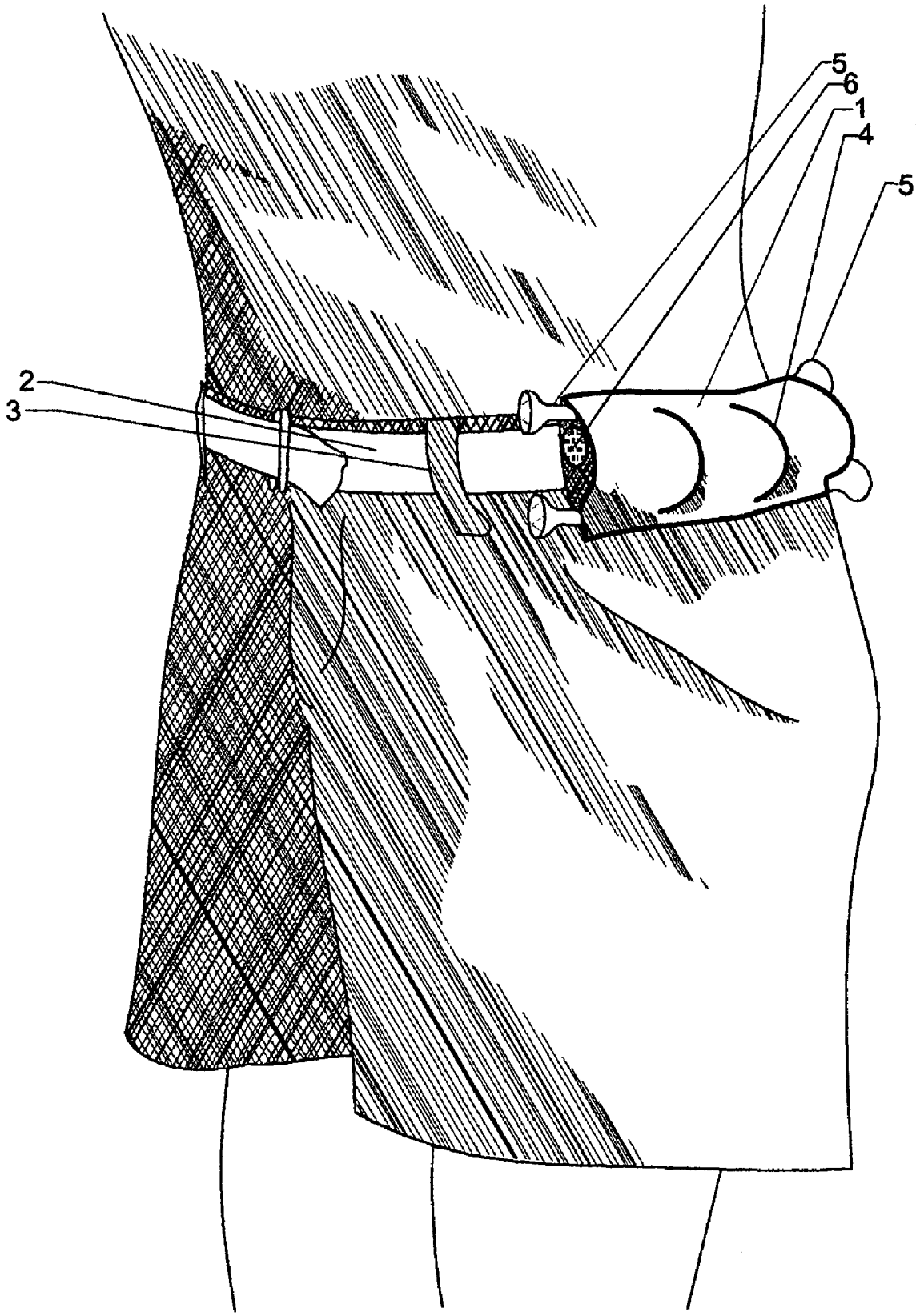
FIG. 1 is a perspective view of the ball pocket as it is attached to the waist.

FIG. 1 shows the pocket or ball carrier being attached on the belt 2 surrounding the wearer to fasten the shorts on the wearer. The belt 2 passes through loops on the shorts at the waist line as is well known. The pocket 1 is made of a flexible as well as stretchable fabric, such as "spandex", although not restricted thereto. The stretchable fabric will hold the balls in the pocket by way of tension as can be seen by the contours 4 of the balls on the outside surface of the pocket. It is important that the extent of the pocket be mounted in a horizontal manner on the waist. This way the balls will not fall out of the pocket even though under tension and the balls can be easier manipulated by a hand either into or out of the pocket 1. The pocket is so designed that other items can be carried in or by the pocket 1. As can be seen, the golf tees 5 can be slipped into the pocket 1 including the ball location markers 6 which can be maintained in the pocket by way of magnets or by a pressure button.

Figure 2:
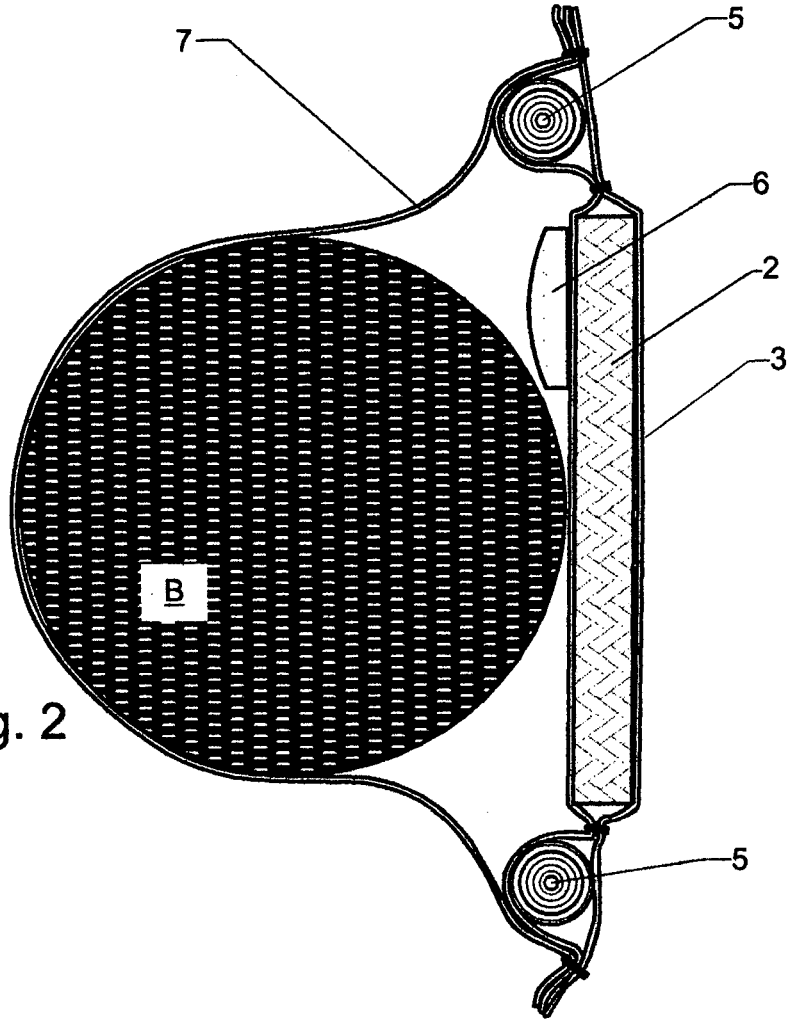
FIG. 2 is a cross-sectional side view through the ball pocket.

FIG. 2 is a cross-sectional side view through the pocket 1, wherein like reference characters have been used as were in FIG. 1. The pocket in this Fig. has been mounted on the belt of the wearer by like loops 3 on the back of the pockets. The loops 3 on the waistband are like the loops 3 in the back of the pockets. The belt 2 will slip through either of the loops. The ball has been designated as B. The location of the ball location marker 6 can be seen as just being inside the pocket 1 and being easily accessible.

Figure 3:
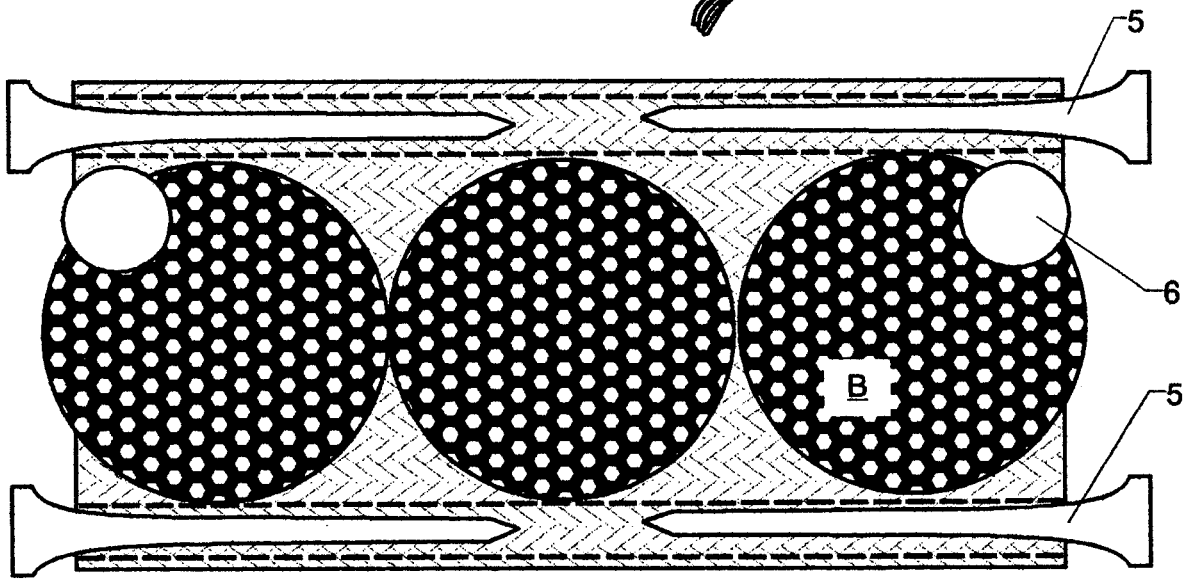
FIG. 3 is a longitudinal cross-section through the ball pocket.

FIG. 3 is cross-sectional view through the pocket 1 but in a longitudinal direction. No new reference characters have been introduced into this Figure and the various items can easily be gleaned from FIGS. 1 and 2.

Figure 4:
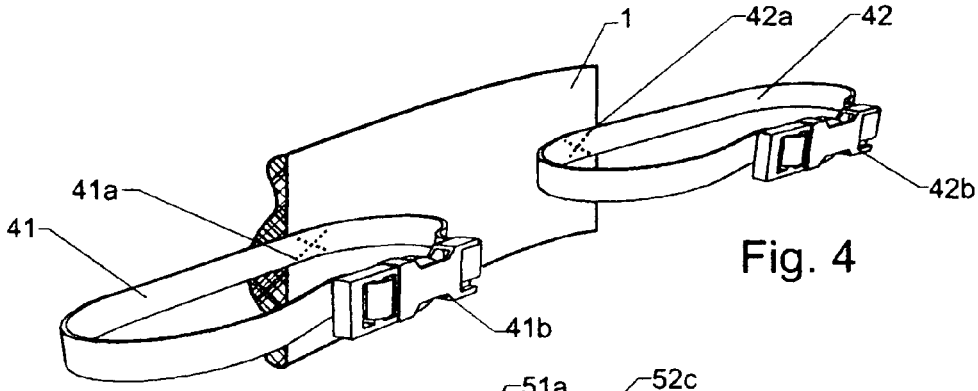
FIG. 4 is a first fastening system of attaching the pocket to a waistband.

FIG. 4 shows a first pocket fastening system to the waistband of shorts where there is no belt available. In this case there is a strap 41 sewn by stitches 41*a* to one back side of the pocket 1 at one end thereof and a second strap 42 is sewn by stitches 42*a* to a back side and to the other end of the pocket 1. The straps are threaded through the vertical slits 61 and 62 (like button holes) and then the ends are fastened to each other by way of the buckles 41*b* and 42*b*. The clip buckles can be adjusted to their proper tension and fit so that the pocket 1 fits snugly on the waist band.

Figure 5:
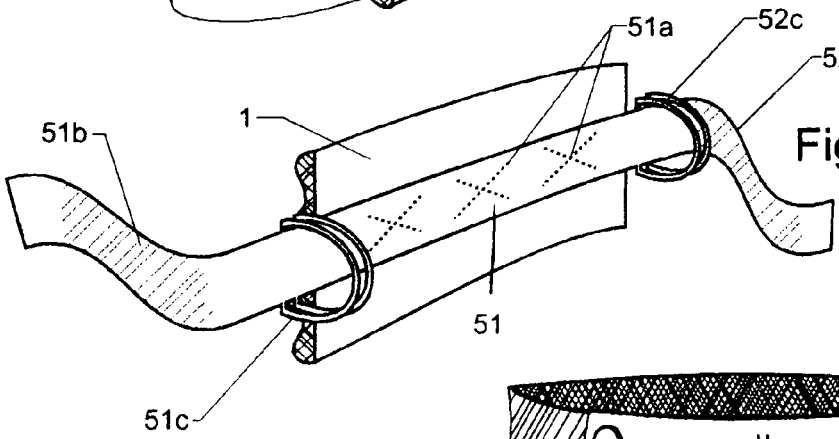
FIG. 5 is a second fastening system of attaching the pocket to a waistband.

FIG. 5 shows a similar fastening system as is shown in FIG. 4. However, in this embodiment there is one long strap 51 attached to the back side of the pocket 1 by way of stitches 51*a*. This strap 51 does not have to be one long strap but could instead be two individual straps that are attached in the manner as shown in FIG. 4 at 41*a* and 42*a*. The long strap 51 has an end 51*b* on one side of the pocket and another end 52*b* at the other side of the pocket. There also is located double D-rings 51*c* on one side of the pocket 1 and double D-rings 52*c* at the other side of the pocket. In operation, the ends 11*b* and 52*b* of the strap 50 are threaded through the vertical slits 61 and 62 of FIG. 6 (like button holes) and then double backed through the D-rings 51*c* and 52*c* and pulled to their proper tension for a snug fit of the pocket on the waist band of the wearer.

Figure 6:
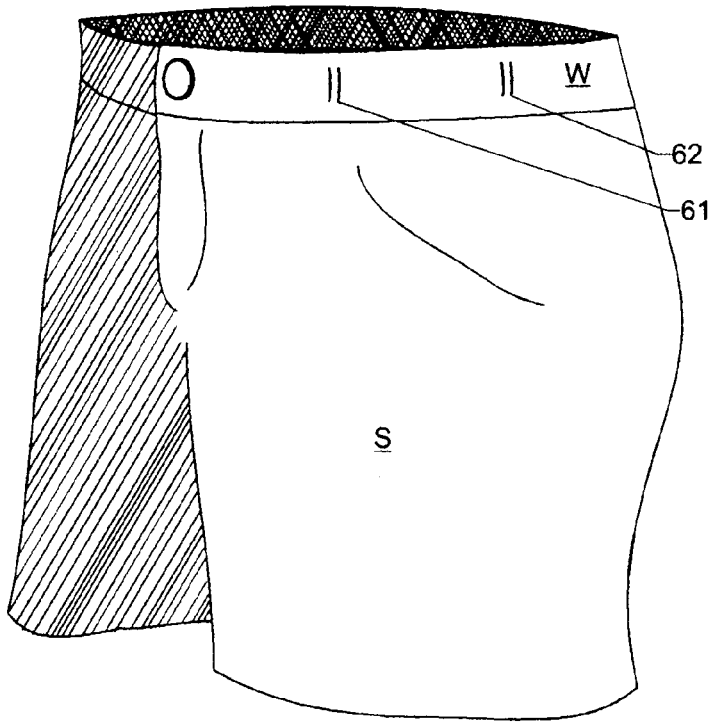
FIG. 6 shows the waistband having been prepared for the first and second fastening system of FIGS. 4 and 5.

FIG. 6 shows a pair of shorts having the vertical slits 61 and 62 placed in the waist band W. Of course, the vertical slits 61 and 62 form each a vertical loop. The fastening systems of FIGS. 4 and 5 can just as easily be used on waist lines having already existing belt loops when the belt is not being used. Two adjacent belt loops can be used in any position around the waisline of a wearer. It is preferred that the slits 61 and 62 be placed on a side of the waist band which is under the arms of the wearer to render the view of the pocket, when installed, most inconspicuous.

Figure 7:
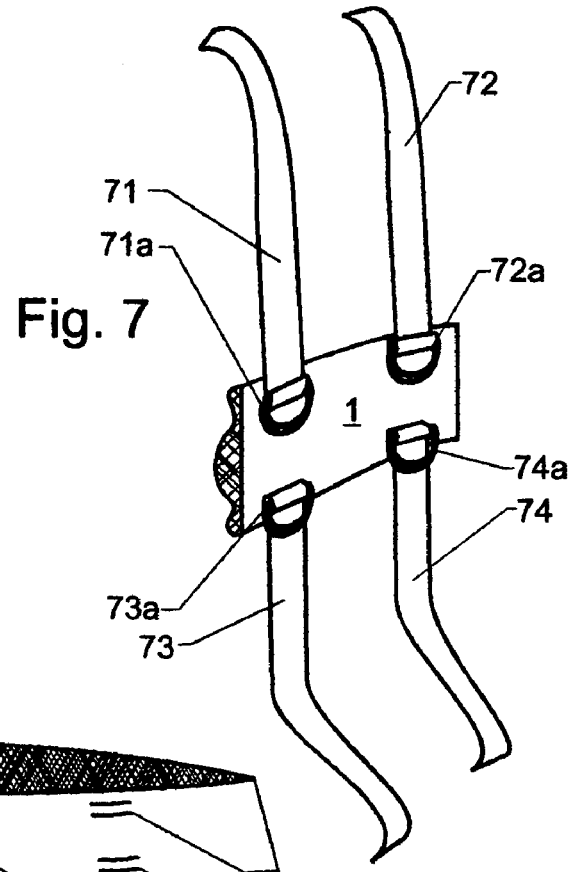
FIG. 7 is a third fastening system of attaching the pocket to a waistband.
Figure 8:
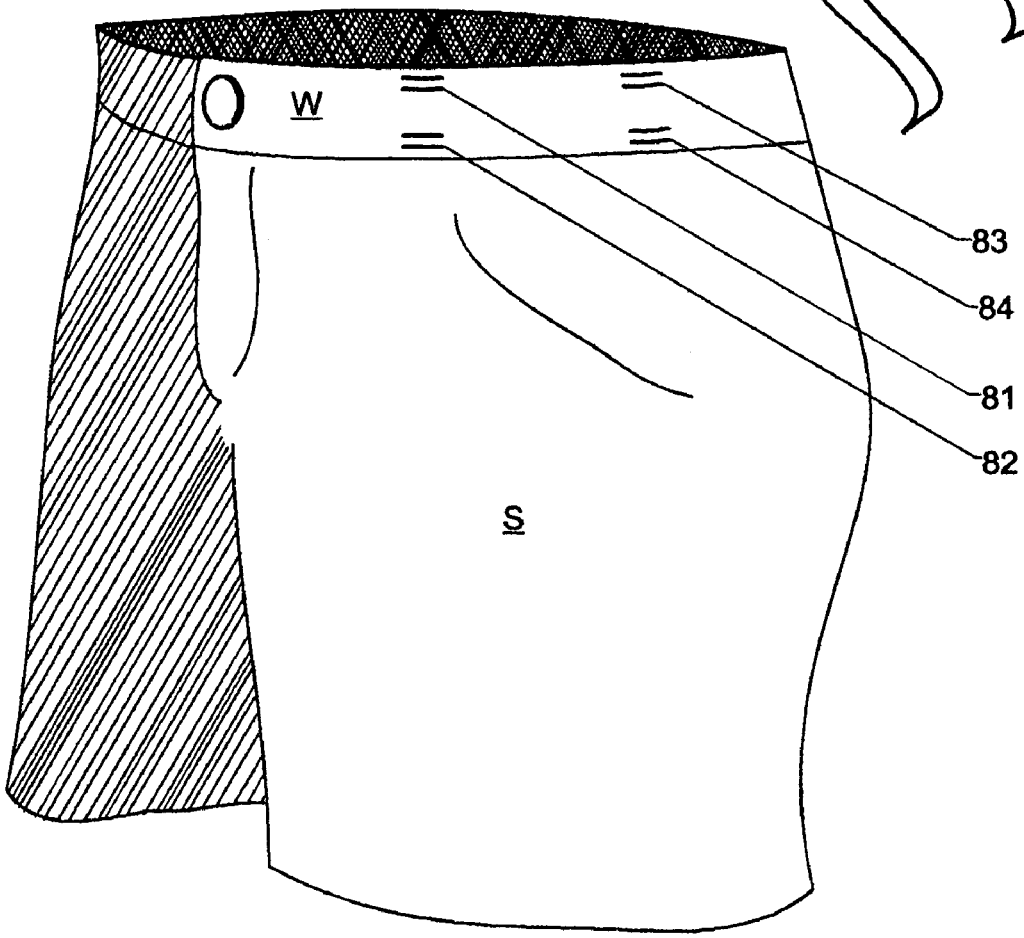
FIG. 8 shows the waistband having been prepared for the fastening system of FIG. 7.

FIG. 7 is a third embodiment of installing the pocket 1 on a waistband having no belt thereon. In this embodiment the pocket 1 has four straps 71 to 74 attached thereon. Each of the straps is attached to each corner of the back side of the pocket whereby two straps will point upwardly and the other two straps will point downwardly. At the point of attachment of each of the straps there have been attached two double D-rings 71*a* to 74*a*. In operation, each of the straps is threaded into each respective double horizontal slits 81 to 84 in FIG. 8 and then each strap is passed through their corresponding D-rings and doubled back on themselves and each strap is fastened in their respective D-rings and pulled to a proper tension, whereby the pocket will snug up against the waist band of the wearer.

Figure 9:
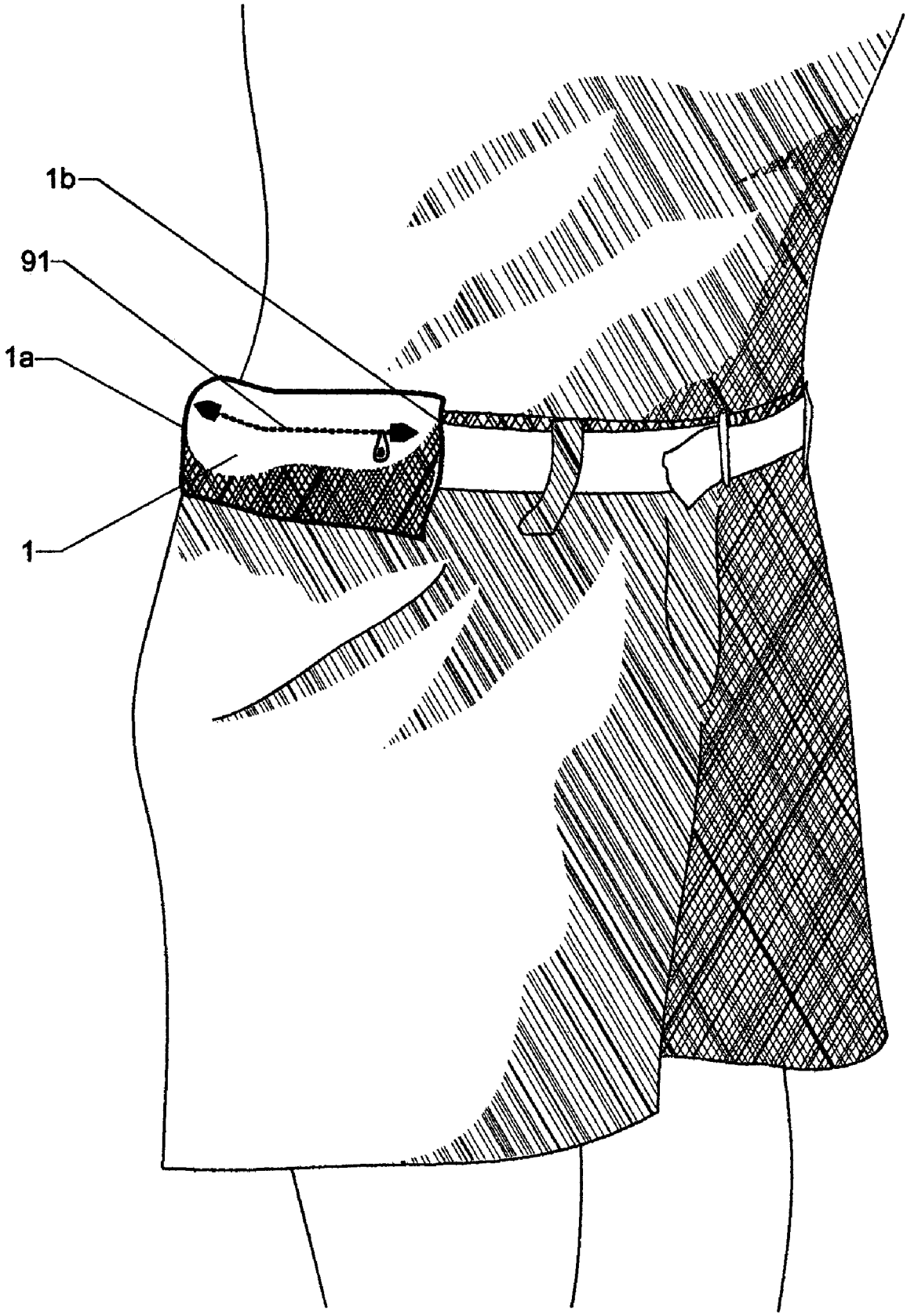
FIG. 9 shows a top closure system for the pocket.

FIG. 9 is the same layout as shown in FIG. 1 except that the top of the pocket is closed by a slide fastener 91 to gain access to the pocket from the top. The sides of the pocket 1 may also be closed to convert the pocket to a container for the storage of glasses or currency.

The location of the pocket can be chosen anywhere around the waistline of a wearer including the backside as long as a belt or fastening loops are available.

What is claimed is:

1. A system for storing golf balls on a waist of a wearer including a pocket of a longitudinal extent having ends and locating said pocket in a horizontal manner and having means for mounting said pocket on a waist band of said wearer, said pocket is constructed of a flexible and stretchable material to snugly hold a multiple of balls within said pocket, said balls may be dispensed one at a time including means for mounting said pocket on said waist band of said wearer, wherein said waist band has placed therein at least two double slits spaced from each other, including a single strap attached to a back side of said pocket to thereby create an end of said strap on each end of said pocket, two double D-rings are each located at each end of said pocket, whereby, when each end of said strap is threaded through each of said double D-rings, each of said ends is received within said D-rings and locked therein after having been passed through said double slits.

2. The system of claim 1 including means for storing golf related items in said pocket.

3. The system of claim 1 including a separable closure located at a top edge of said pocket.

4. The system of claim 3, wherein side edges of said pocket are closed to thereby form a completely closed pocket.

* * * * *